US010151441B2

(12) United States Patent
Ito et al.

(10) Patent No.: US 10,151,441 B2
(45) Date of Patent: Dec. 11, 2018

(54) LIGHT EMITTING DEVICE AND VEHICLE LAMP

(71) Applicant: KOITO MANUFACTURING CO., LTD., Tokyo (JP)

(72) Inventors: Toru Ito, Shizuoka (JP); Masaya Shido, Shizuoka (JP); Takayuki Otsubo, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 298 days.

(21) Appl. No.: 14/870,708

(22) Filed: Sep. 30, 2015

(65) Prior Publication Data

US 2016/0102833 A1 Apr. 14, 2016

(30) Foreign Application Priority Data

Oct. 8, 2014 (JP) ..... 2014-206953
Mar. 13, 2015 (JP) ..... 2015-050365
Aug. 6, 2015 (JP) ..... 2015-155908

(51) Int. Cl.
*F21S 43/247* (2018.01)
*F21S 8/10* (2006.01)
(Continued)

(52) U.S. Cl.
CPC ..... *F21S 48/217* (2013.01); *F21S 43/145* (2018.01); *F21S 43/19* (2018.01); *F21S 43/239* (2018.01);
(Continued)

(58) Field of Classification Search
CPC .. F21S 48/211; F21S 48/2212; F21S 48/2243; F21S 48/2262; F21S 48/2287
See application file for complete search history.

(56) References Cited

U.S. PATENT DOCUMENTS 6,459,418 B1 * 10/2002 Comiskey ..... B41J 2/01 345/107
6,520,669 B1 * 2/2003 Chen ..... B60Q 1/2696 313/511
(Continued)

FOREIGN PATENT DOCUMENTS

CN 203273693 U 11/2013
CN 103672659 A 3/2014
(Continued)

OTHER PUBLICATIONS

Machine Translation of JP 2001023412 A.*
(Continued)

*Primary Examiner* — Robert May
*Assistant Examiner* — Leah S Macchiarolo
(74) *Attorney, Agent, or Firm* — Sughrue Mion, PLLC

(57) ABSTRACT

A light emitting device includes a planar light emitting body configured to emit light in a planar shape, and a transparent member configured to control the light from the planar light emitting body. The transparent member has a light incidence surface arranged so as to face a light emitting surface of the planar light emitting body and configured to cause the light from the planar light emitting body to be incident on the transparent member and a light emission surface configured to emit, to the outside, the light which is propagated in the transparent member. The transparent member is formed so as to extend in a predetermined direction and formed such that a distance between the light incidence surface and the light emission surface changes in accordance with a position in the predetermined direction.

13 Claims, 15 Drawing Sheets

(51) Int. Cl.

| | |
|---|---|
| ***F21S 43/19*** | (2018.01) |
| ***F21S 43/145*** | (2018.01) |
| ***F21S 43/20*** | (2018.01) |
| ***F21S 43/239*** | (2018.01) |
| ***F21S 43/243*** | (2018.01) |
| *F21Y 105/00* | (2016.01) |
| *F21Y 115/20* | (2016.01) |

(52) U.S. Cl.
CPC ..... *F21S 43/243* (2018.01); *F21S 43/247* (2018.01); *F21S 43/26* (2018.01); *F21Y 2105/00* (2013.01); *F21Y 2115/20* (2016.08)

(56) References Cited

U.S. PATENT DOCUMENTS

| | | | | |
|---|---|---|---|---|
| 2008/0002429 | A1 | 1/2008 | Noba | |
| 2012/0081915 | A1* | 4/2012 | Foote | B60R 1/12 362/494 |
| 2013/0049570 | A1* | 2/2013 | Natsume | B60Q 1/0041 313/498 |
| 2013/0077334 | A1* | 3/2013 | Otsubo | F21S 48/211 362/509 |
| 2014/0071703 | A1 | 3/2014 | Motomura | |
| 2015/0338063 | A1* | 11/2015 | Buckley | F21K 2/00 362/551 |
| 2015/0345737 | A1* | 12/2015 | Ito | F21S 48/25 362/520 |
| 2016/0004002 | A1* | 1/2016 | Yoshida | B29D 11/0048 362/511 |
| 2016/0076721 | A1* | 3/2016 | Meyrenaud | F21S 48/1154 362/522 |
| 2016/0076729 | A1* | 3/2016 | Jin | B60Q 1/0041 362/509 |
| 2017/0059113 | A1* | 3/2017 | Gloss | F21S 48/211 |
| 2017/0130928 | A1* | 5/2017 | Duval | F21S 48/20 |
| 2017/0133348 | A1* | 5/2017 | Shido | H01L 25/048 |
| 2017/0159905 | A1* | 6/2017 | Shido | F21S 48/24 |

FOREIGN PATENT DOCUMENTS

| | | | | |
|---|---|---|---|---|
| DE | 102012202508 | A1 | | 9/2013 |
| FR | 2905448 | A1 | | 3/2008 |
| JP | 2001023412 | A | * | 1/2001 |
| JP | 2011150887 | A | | 8/2011 |
| JP | 2011-228168 | A | | 11/2011 |
| WO | 01/98708 | A1 | | 12/2001 |

OTHER PUBLICATIONS

Communication dated Feb. 28, 2018, issued by the French Patent Office in counterpart French Application No. 1559525.

Communication issued by the State Intellectual Property Office of P.R. China dated Aug. 3, 2017 in counterpart Chinese Patent Application No. 201510645123.5.

* cited by examiner

LIGHT EMITTING DEVICE AND VEHICLE LAMP

CROSS-REFERENCE TO RELATED APPLICATION

The present application claims priorities from Japanese Patent Application No. 2014-206953 filed on Oct. 8, 2014, Japanese Patent Application No. 2015-050365 filed on Mar. 13, 2015 and Japanese Patent Application No. 2015-155908 filed on Aug. 6, 2015, the entire content of which is incorporated herein by reference.

BACKGROUND

Technical Field

The present disclosure relates to a light emitting device and a vehicle lamp using the light emitting device.

Related Art

In a related art, in order to reduce the thickness and size of a vehicle lamp, a vehicle lamp that uses a planar light emitting body such as an organic EL (Electro Luminescence) panel as a light source has been suggested (e.g., see Patent Document 1).

Patent Document 1: Japanese Patent Laid-Open Publication No. 2011-150887

Typically, a planar light emitting body such as an organic EL panel has a flat light emitting surface. Accordingly, a vehicle lamp using a planar light emitting body tends to be a uniform design.

SUMMARY

Exemplary embodiments of the invention provide a light emitting device using a planar light emitting body, whose design is improved and a vehicle lamp including the light emitting device.

A light emitting device according to an exemplary embodiment comprises: a planar light emitting body configured to emit light in a planar shape; and a transparent member configured to control the light from the planar light emitting body. The transparent member has a light incidence surface arranged so as to face a light emitting surface of the planar light emitting body and configured to cause the light from the planar light emitting body to be incident on the transparent member and a light emission surface configured to emit, to the outside, the light which is propagated in the transparent member. The transparent member is formed so as to extend in a predetermined direction and formed such that a distance between the light incidence surface and the light emission surface changes in accordance with a position in the predetermined direction.

Here, "propagation" includes not only a phenomenon that light is transmitted through a lens or the like, but also a phenomenon that light travels while repeating the total reflection in the interior of a light guide.

The light incidence surface may be formed in a wave shape or a step shape in the predetermined direction.

The transparent member may have a bent portion between the light incidence surface and the light emission surface.

The bent portion may be spaced from the light emission surface in the normal direction of the light emitting surface of the planar light emitting body.

The light emission surface may be bent in the predetermined direction.

An air layer may be provided between the light emitting surface of the planar light emitting body and the transparent member.

A diffusion process for diffusing the light emitted to the outside from the light emission surface may be performed on at least a portion of the light emission surface. The diffusion process may be a frosting process. Further, the diffusion process may be a process of sticking a diffusion member such as a diffusion sheet to a light emission surface.

Another aspect of the present invention is a vehicle lamp using the light emitting device described above as a light source.

According to the present invention, it is possible to improve the design of a light emitting device and a vehicle lamp, which use a planar light emitting body.

DETAILED DESCRIPTION

Hereinafter, a light emitting device according an embodiment of the present invention and a vehicle lamp using the light emitting device will be described in detail with reference to the drawings. In the present specification, in the case where a direction-indicating term such as "upper," "lower," "front," "rear," "left," "right," "inner" and "outer" is used, these terms mean directions in a posture when a vehicle lamp is mounted to a vehicle.

Figure 1:
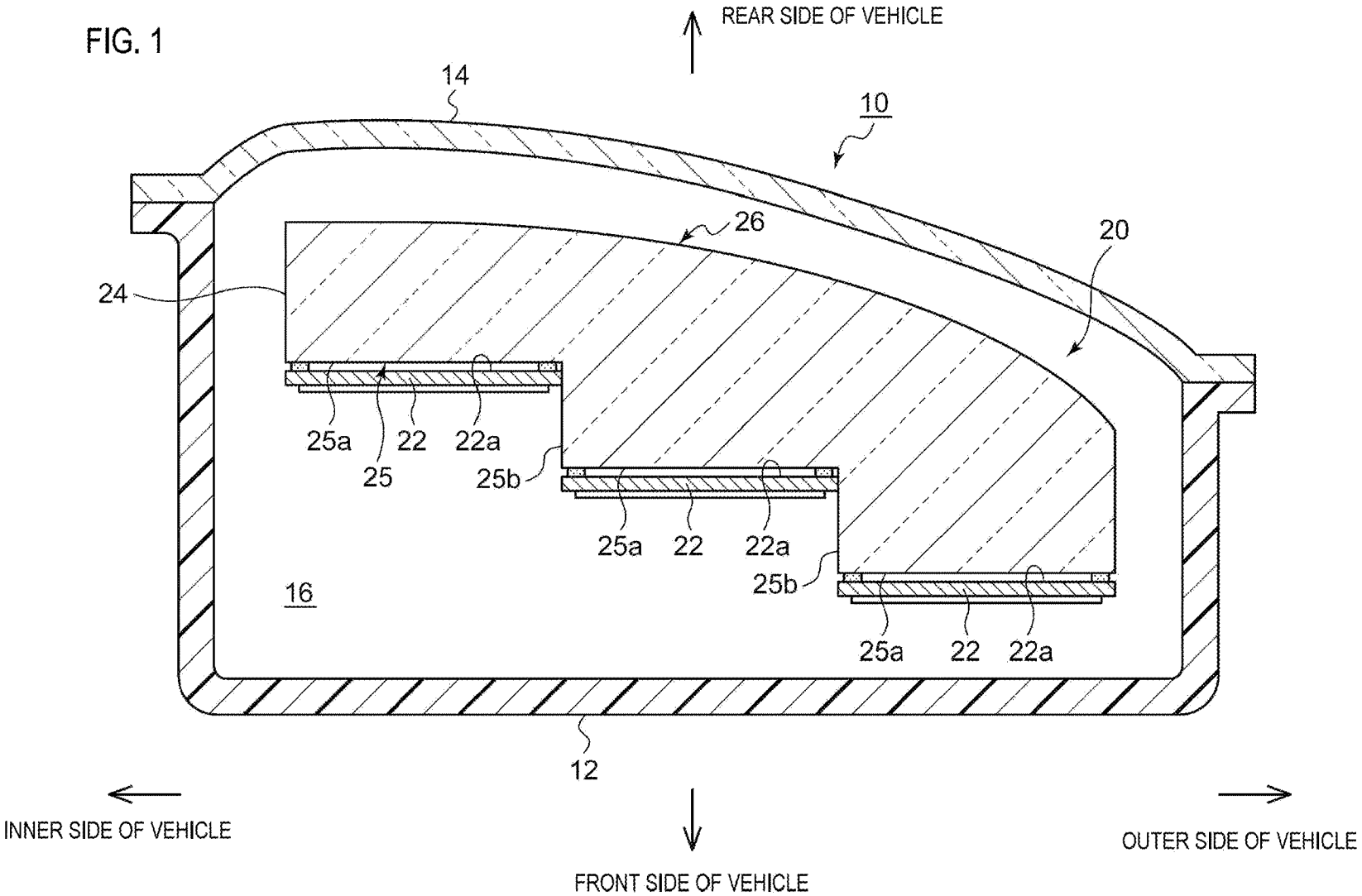
FIG. 1 is a schematic sectional view for explaining a vehicle lamp according to an embodiment of the present invention.

FIG. 1 is a schematic sectional view for explaining a vehicle lamp 10 according to an embodiment of the present invention. The vehicle lamp 10 illustrated in FIG. 1 is a tail lamp which is provided in a rear left portion of a vehicle.

As shown in FIG. 1, the vehicle lamp 10 includes a lamp body 12, a transparent cover 14 for covering a front opening portion of the lamp body 12, and a light emitting device 20 provided in a lamp chamber 16 which is defined by the lamp body 12 and the cover 14. The light emitting device 20 is fixed to the lamp body 12 by a support member (not shown).

As shown in FIG. 1, the cover 14 has a shape to follow the shape of a rear portion of a vehicle and is smoothly inclined to the front side of the vehicle toward the outer side from the inner side of the vehicle.

Figure 2:
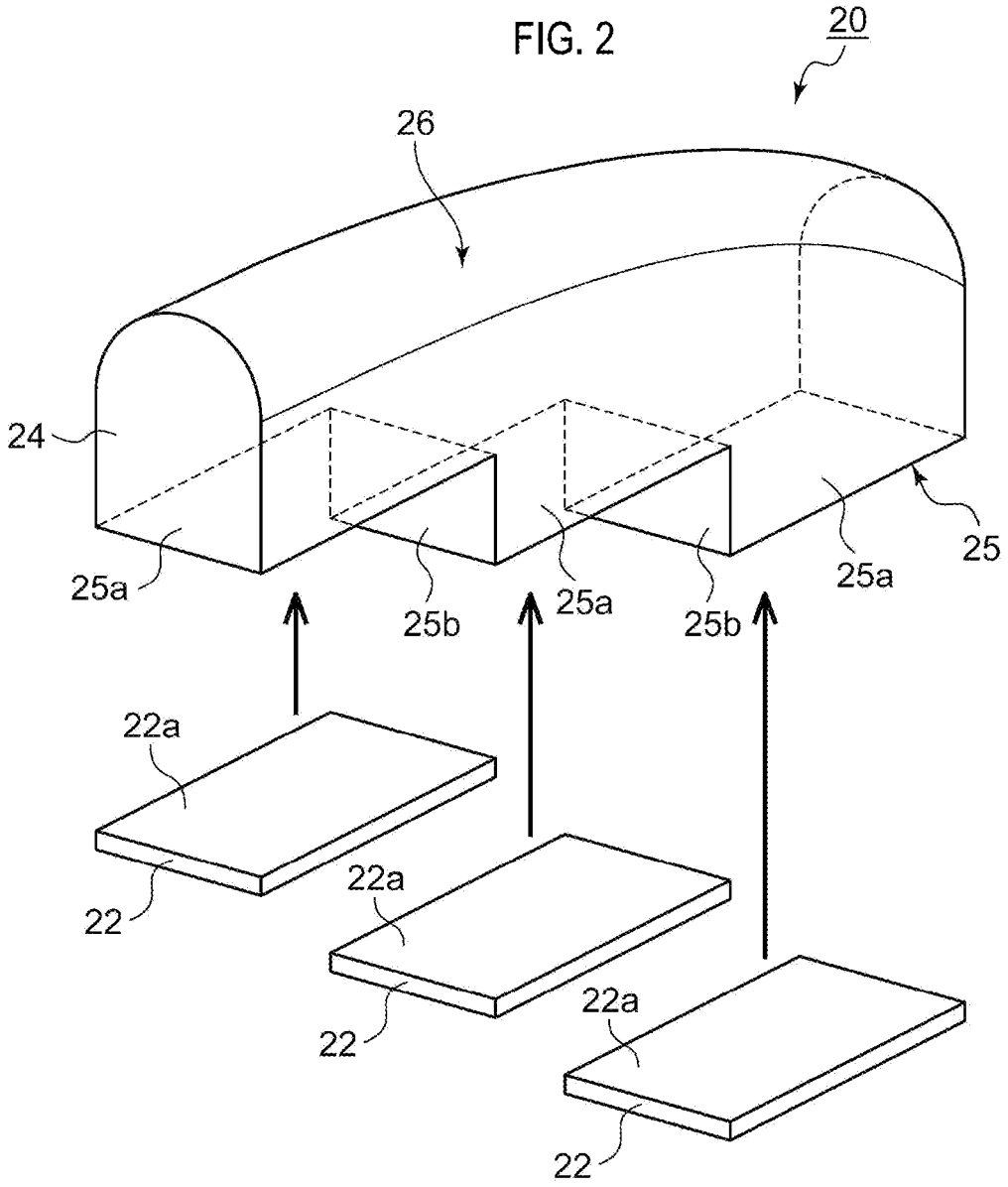
FIG. 2 is a schematic exploded perspective view of a light emitting device according to the embodiment of the present invention.

FIG. 2 is a schematic exploded perspective view of the light emitting device 20 according to an embodiment of the present invention. As shown in FIGS. 1 and 2, the light emitting device 20 includes three planar organic EL panels 22 and a transparent member 24 which is formed and disposed so as to cover light emitting surfaces 22*a* of the organic EL panels 22. Each of the organic EL panels 22 emits light in a planar shape. The transparent member 24 controls the light from the organic EL panels 22 and emits the light to the front of the vehicle. Although the organic EL panel is illustrated as an example of the planar light emitting body in the present embodiment, the planar light emitting body is not limited to the organic EL panel.

The transparent member 24 is a substantially columnar body (columnar body having a semi-cylindrical section) which is formed so as to extend in a vehicle width direction (vehicle inside-outside direction). The transparent member 24 may be formed of an optical glass or a transparent resin such as an acrylic, for example. The transparent member 24 has a light incidence surface 25 arranged so as to face the light emitting surfaces 22*a* of the organic EL panels 22 and a light emission surface 26 arranged so as to face the light incidence surface 25. The light incident on the transparent member 24 from the light incidence surface 25 is propagated (transmitted) in the transparent member 24, and then, emitted to the outside from the light emission surface 26.

As shown in FIG. 1, the light emission surface 26 of the transparent member 24 has a shape to follow the shape of the cover 14 and is smoothly inclined to the front side of the vehicle toward the outer side from the inner side of the vehicle. On the other hand, the light incidence surface 25 of the transparent member 24 is formed in a stepwise manner along the vehicle width direction. The stepped light incidence surface 25 is composed of three stage surfaces 25*a* facing the light emission surface 26 and two stepped surfaces 25*b* connecting the stage surfaces 25*a*. One organic EL panel 22 is arranged so as to face each stage surface 25*a*. In the present embodiment, the light emitting surface 22*a* of the organic EL panel 22 and the stage surface 25*a* of the light incidence surface 25 of the transparent member 24 are spaced apart from each other and an air layer is provided therebetween.

In this way, the transparent member 24 has the light incidence surface 25 which is formed in a stepwise manner along the vehicle width direction, and the light emission surface 26 which is smoothly inclined to the front side of the vehicle toward the outer side from the inner side of the vehicle. By having the light incidence surface 25 and the light emission surface 26 configured in this manner, the transparent member 24 of the present embodiment is configured such that a distance between the light incidence surface 25 and the light emission surface 26 changes in accordance with a position in the vehicle width direction. Here, in the present embodiment, the "distance" means a linear distance between the light incidence surface 25 and the light emission surface 26. By changing the distance between the light incidence surface 25 and the light emission surface 26 in accordance with the position in the vehicle width direction in this manner, the light emitting device 20 according to the present embodiment can present a depth feeling (three-dimensional appearance) to a viewer during light emission, thereby improving the design. It should be noted that the light emitting device 20 according to the present embodiment can present a depth feeling by using the planar organic EL panel 22.

Further, typically, it is difficult to cause the planar organic EL panel to follow a curved surface of the cover 14. However, by using the transparent member 24 according to the present embodiment, the light emission surface 26 of the front surface of the transparent member 24 is formed so as to follow the curved surface of the cover 14, and the light incidence surface 25 of the rear surface of the transparent member 24 is formed so as to face the organic EL panel. As a result, the light emission surface 26 can realize an appearance similar to the case where the organic EL panel is arranged along the curved surface of the cover 14.

Figure 3:
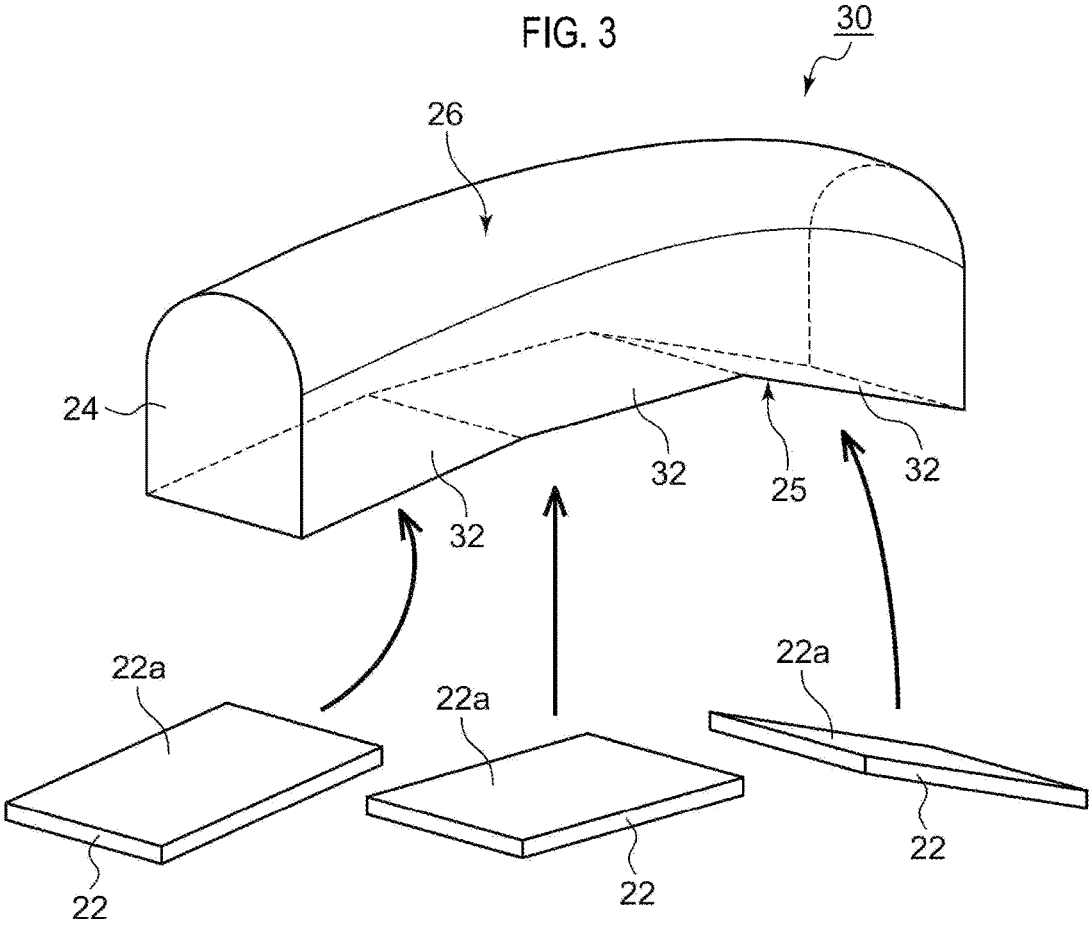
FIG. 3 is a schematic exploded perspective view of a light emitting device according to another embodiment of the present invention.

FIG. 3 is a schematic exploded perspective view of a light emitting device 30 according to another embodiment of the present invention. The light emitting device 30 also includes three planar organic EL panels 22 and the transparent member 24 that is a substantially columnar body. The light emission surface 26 of the transparent member 24 has a shape to follow the shape of the cover 14 and is smoothly inclined to the front side of the vehicle toward the outer side from the inner side of the vehicle. On the other hand, the light incidence surface 25 of the transparent member 24 is composed of three planar surfaces 32 arranged side by side in the vehicle width direction. These three planar surfaces 32 are bent and connected to each other. One organic EL panel 22 is arranged so as to face each planar surface 32. Also in the present embodiment, the light emitting surface 22*a* of the organic EL panel 22 and the planar surface 32 of the light incidence surface 25 of the transparent member 24 are spaced apart from each other and an air layer is provided therebetween.

Also in the light emitting device 30 according to the present embodiment, the distance between the light incidence surface 25 and the light emission surface 26 changes in accordance with the position in the vehicle width direction. As a result, the light emitting device 30 according to the present embodiment can also present a depth feeling (three-dimensional appearance) to a viewer during light emission, thereby improving the design. Further, also in the light emitting device 30 according to the present embodiment, the light emission surface 26 can realize an appearance similar to the case where the organic EL panel 22 is arranged along the curved surface of the cover 14, in spite of the fact that the planar organic EL panel 22 is used.

Figure 4:
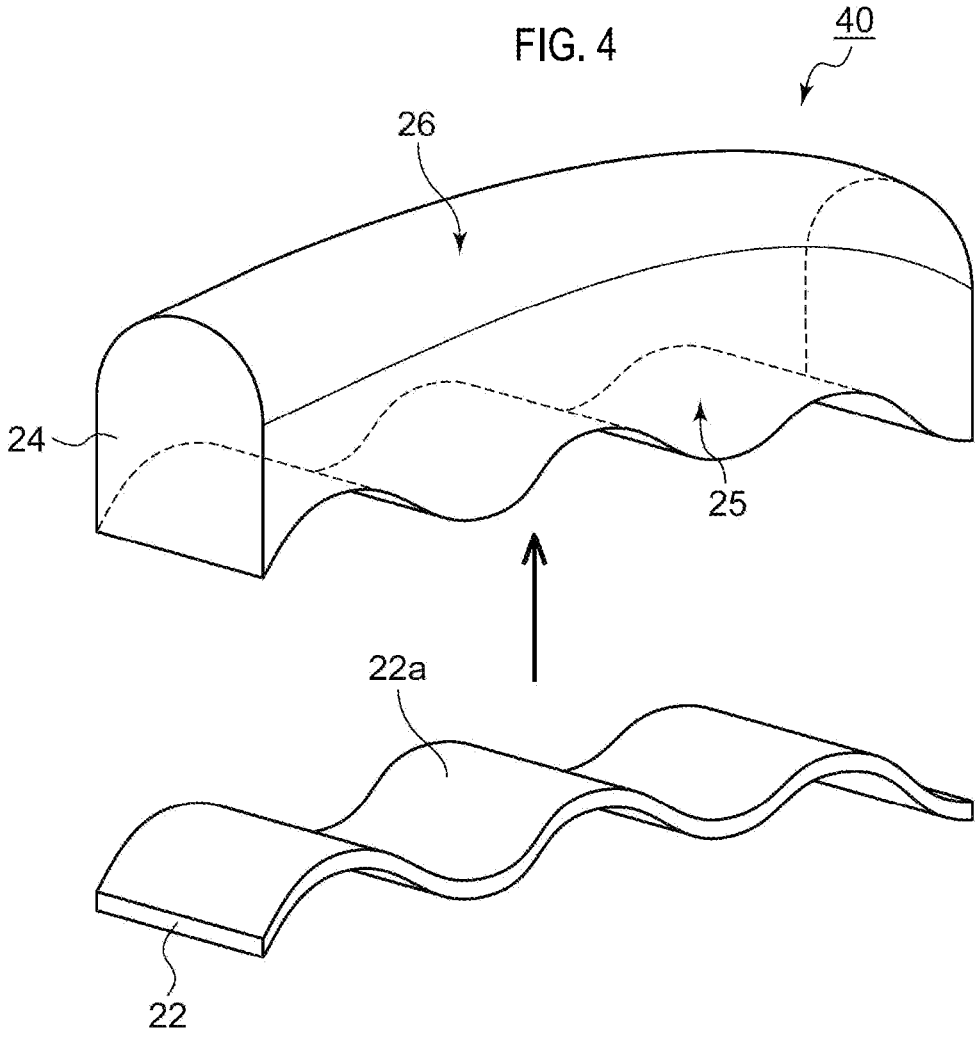
FIG. 4 is a schematic exploded perspective view of a light emitting device according to yet another embodiment of the present invention.

FIG. 4 is a schematic exploded perspective view of a light emitting device 40 according to yet another embodiment of the present invention. The light emitting device 40 also includes the organic EL panel 22 having a curved shape and the transparent member 24 that is a substantially columnar body. The light emission surface 26 of the transparent member 24 has a shape to follow the shape of the cover 14 and is smoothly inclined to the front side of the vehicle toward the outer side from the inner side of the vehicle. On the other hand, the light incidence surface 25 of the transparent member 24 is formed in a wave shape (e.g., a sinusoidal shape) along the vehicle width direction.

In the light emitting device 40 according to the present embodiment, the organic EL panel 22 is a flexible organic EL panel. The organic EL panel 22 has a wave shape (e.g., a sinusoidal shape) along the vehicle width direction so as to correspond to the light incidence surface 25 of the transparent member 24. The organic EL panel 22 is arranged such that the light emitting surface 22*a* corresponds to the light incidence surface 25. Also in the present embodiment, the light emitting surface 22*a* of the organic EL panel 22 and the light incidence surface 25 of the transparent member 24 are spaced apart from each other and an air layer is provided therebetween.

Also in the light emitting device 40 according to the present embodiment, the distance between the light incidence surface 25 and the light emission surface 26 changes in accordance with the position in the vehicle width direction. As a result, the light emitting device 40 according to the present embodiment can also present a depth feeling (three-dimensional appearance) to a viewer during light emission, thereby improving the design.

Figure 5:
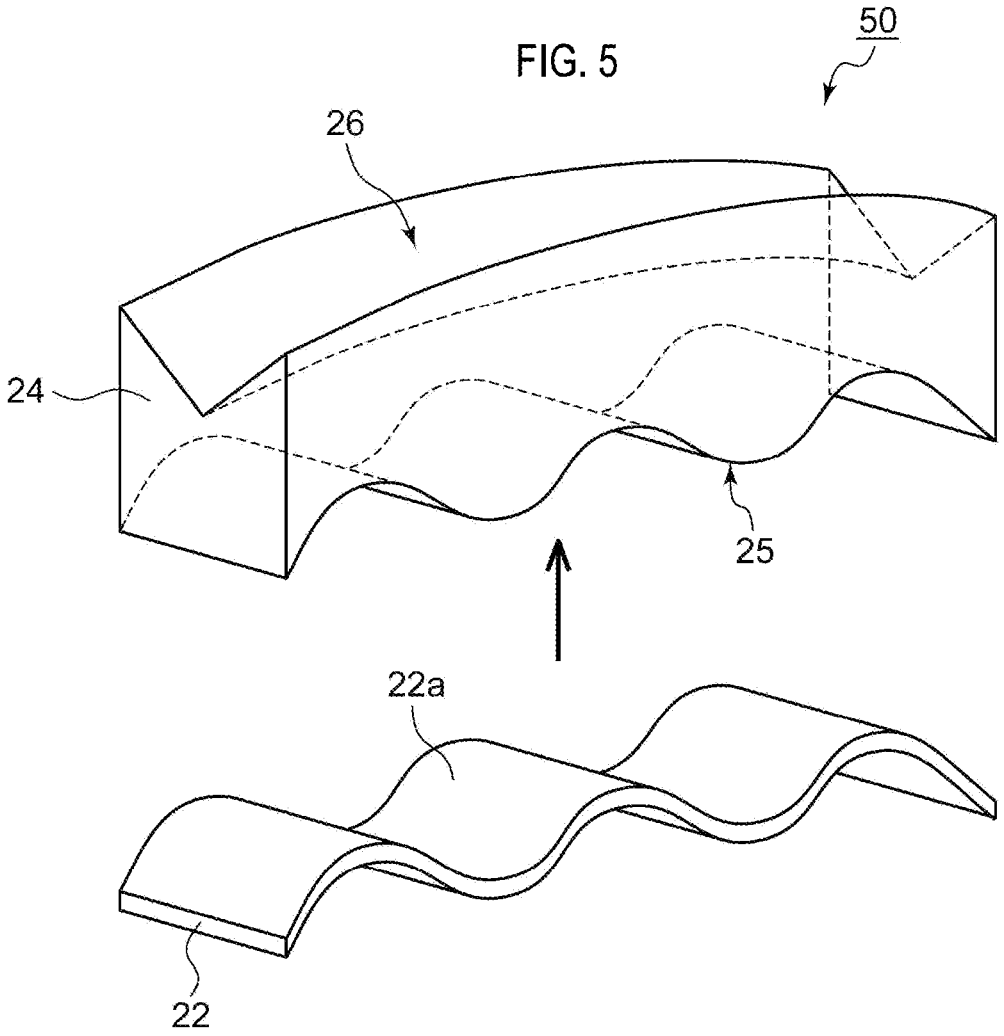
FIG. 5 is a schematic exploded perspective view of a light emitting device according to yet another embodiment of the present invention.

FIG. 5 is a schematic exploded perspective view of a light emitting device 50 according to yet another embodiment of the present invention. The light emitting device 50 also includes the organic EL panel 22 having a curved shape and the transparent member 24 that is a substantially columnar body. The light emission surface 26 of the transparent member 24 has a shape to follow the shape of the cover 14 and is smoothly inclined to the front side of the vehicle toward the outer side from the inner side of the vehicle. In the present embodiment, the light emission surface 26 of the transparent member 24 has a V-shaped section. On the other hand, the light incidence surface 25 of the transparent member 24 is formed in a wave shape (e.g., a sinusoidal shape) along the vehicle width direction.

Also in the light emitting device 50 according to the present embodiment, the organic EL panel 22 is a flexible organic EL panel. The organic EL panel 22 has a wave shape (e.g., a sinusoidal shape) along the vehicle width direction so as to correspond to the light incidence surface 25 of the transparent member 24. The organic EL panel 22 is arranged such that the light emitting surface 22*a* corresponds to the light incidence surface 25. Also in the present embodiment, the light emitting surface 22*a* of the organic EL panel 22 and the light incidence surface 25 of the transparent member 24 are spaced apart from each other and an air layer is provided therebetween.

Also in the light emitting device 50 according to the present embodiment, the distance between the light incidence surface 25 and the light emission surface 26 changes in accordance with the position in the vehicle width direction. As a result, the light emitting device 50 according to the present embodiment can also present a depth feeling (three-dimensional appearance) to a viewer during light emission, thereby improving the design.

Figure 6:
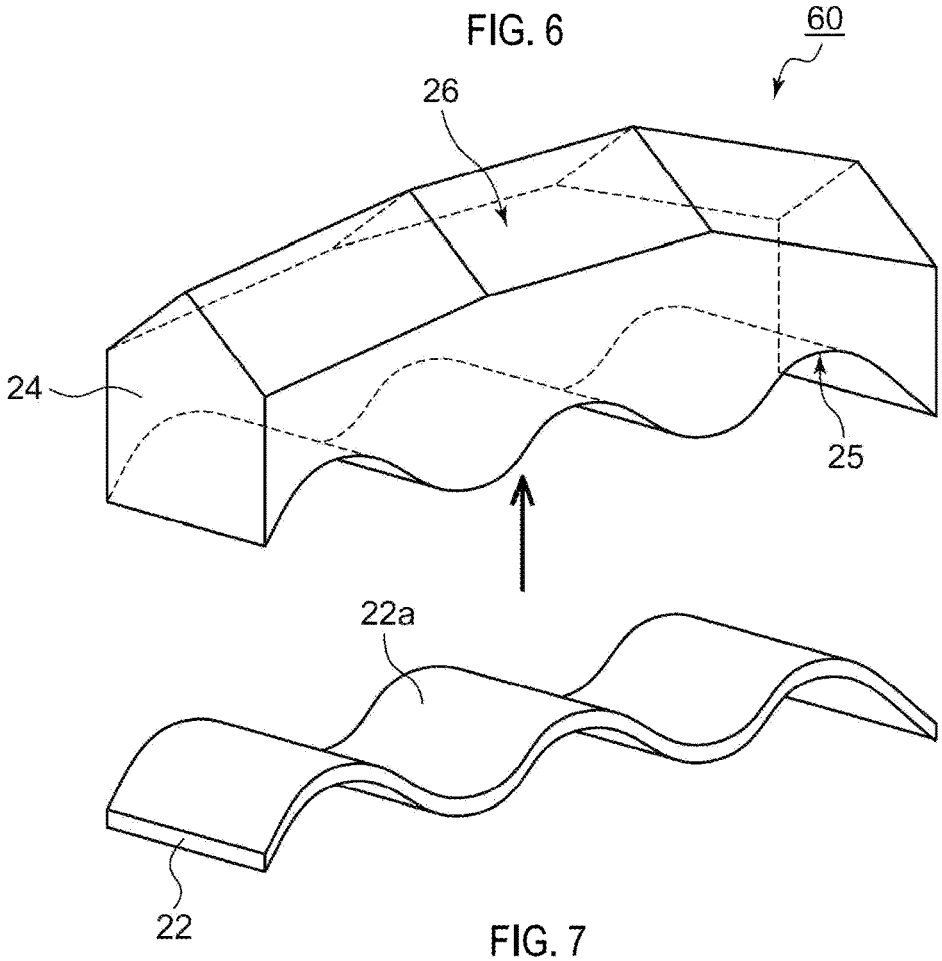
FIG. 6 is a schematic exploded perspective view of a light emitting device according to yet another embodiment of the present invention.

FIG. 6 is a schematic exploded perspective view of a light emitting device 60 according to yet another embodiment of the present invention. The light emitting device 60 also includes the organic EL panel 22 having a curved shape and the transparent member 24 that is a substantially columnar body. The light emission surface 26 of the transparent member 24 has a shape to follow the shape of the cover 14 and is smoothly inclined to the front side of the vehicle toward the outer side from the inner side of the vehicle. In the present embodiment, the light emission surface 26 of the transparent member 24 has a triangular section. On the other hand, the light incidence surface 25 of the transparent member 24 is formed in a wave shape (e.g., a sinusoidal shape) along the vehicle width direction.

Also in the light emitting device 60 according to the present embodiment, the organic EL panel 22 is a flexible organic EL panel. The organic EL panel 22 has a wave shape (e.g., a sinusoidal shape) along the vehicle width direction so as to correspond to the light incidence surface 25 of the transparent member 24. The organic EL panel 22 is arranged such that the light emitting surface 22*a* corresponds to the light incidence surface 25. Also in the present embodiment, the light emitting surface 22*a* of the organic EL panel 22 and the light incidence surface 25 of the transparent member 24 are spaced apart from each other and an air layer is provided therebetween.

Also in the light emitting device 60 according to the present embodiment, the distance between the light incidence surface 25 and the light emission surface 26 changes in accordance with the position in the vehicle width direction. As a result, the light emitting device 60 according to the present embodiment can also present a depth feeling (three-dimensional appearance) to a viewer during light emission, thereby improving the design.

Figure 7:
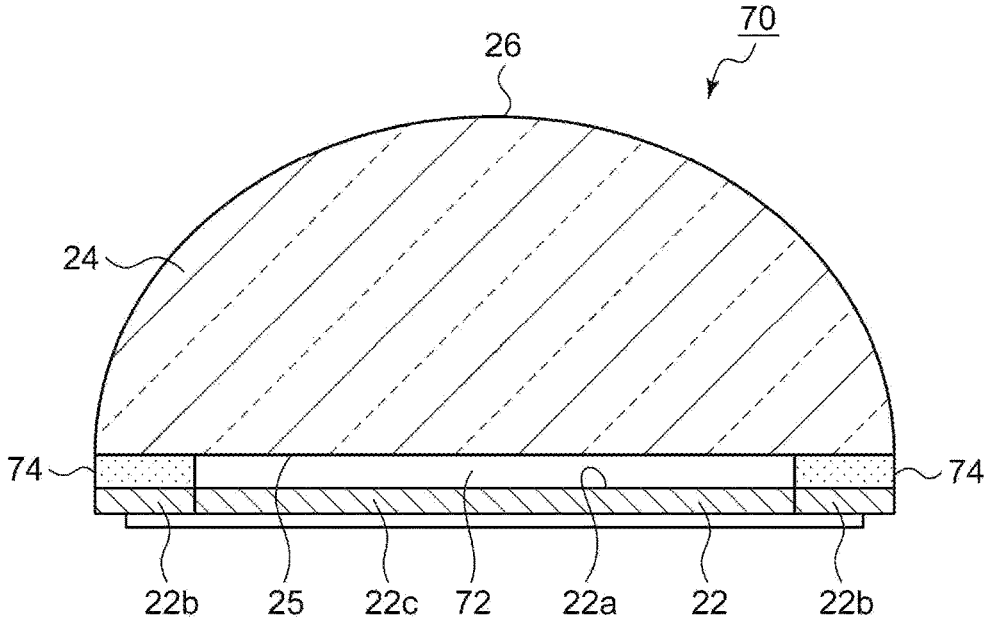
FIG. 7 is a view for explaining an assembly structure of the light emitting device according to the embodiment of the present invention.

FIG. 7 is a view for explaining an assembly structure of the light emitting device according to the embodiment of the present invention. FIG. 7 is a sectional view perpendicular to an extension direction of a light emitting device 70. As shown in FIG. 7, the light emitting device 70 is configured such that the light emitting surface 22*a* of the organic EL panel 22 and the light incidence surface 25 of the transparent member 24 are spaced apart from each other and an air layer 72 is provided therebetween.

The light emitting device 70 shown in FIG. 7 is configured such that the organic EL panel 22 and the transparent member 24 are fixed to each other by an adhesive 74. The adhesive 74 is provided on a non-emitting portion 22*b* which is located at an end portion of the organic EL panel 22, and thus, does not block the light emitted from a light emitting portion 22*c*. The adhesive 74 also serves to define a distance between the light emitting surface 22*a* of the organic EL panel 22 and the light incidence surface 25 of the transparent member 24.

Figure 8:
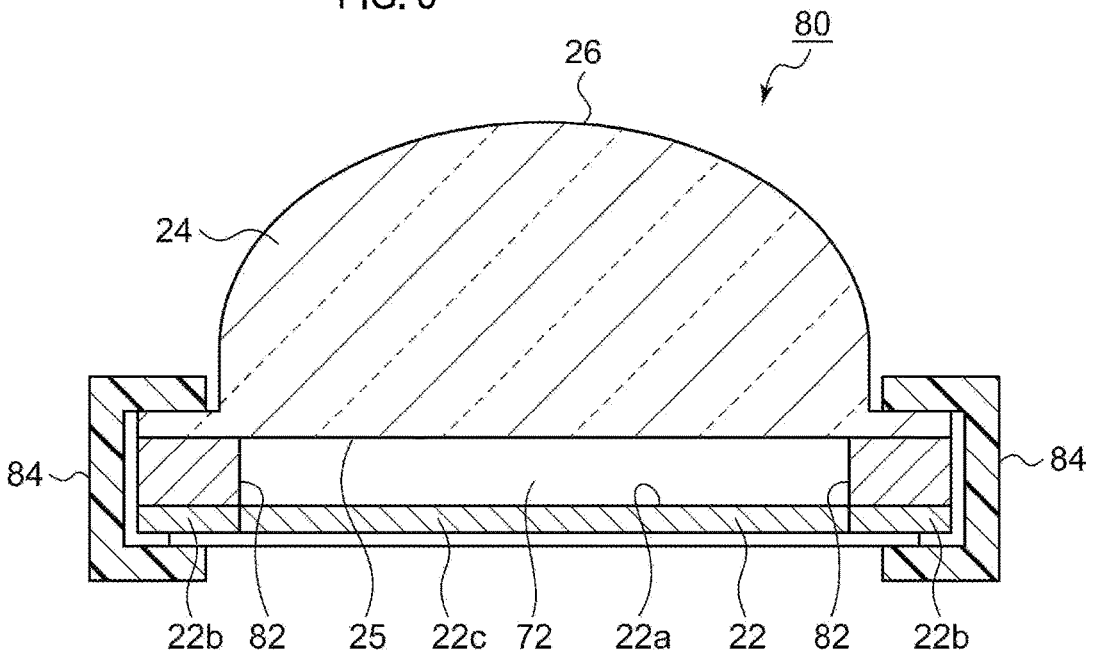
FIG. 8 is a view for explaining another assembly structure of the light emitting device according to the embodiment of the present invention.

FIG. 8 is a view for explaining another assembly structure of the light emitting device according to the embodiment of the present invention. FIG. 8 is a sectional view perpendicular to an extension direction of a light emitting device 80. As shown in FIG. 8, the light emitting device 80 is configured such that the light emitting surface 22*a* of the organic EL panel 22 and the light incidence surface 25 of the transparent member 24 are spaced apart from each other and the air layer 72 is provided therebetween.

The light emitting device 80 shown in FIG. 8 includes a spacer 82 for defining a distance between the light emitting surface 22*a* of the organic EL panel 22 and the light incidence surface 25 of the transparent member 24. The spacer 82 is located therebetween. Further, the light emitting device 80 includes a bracket 84 for clamping and fixing the transparent member 24, the spacer 82 and the organic EL panel 22.

The light emitting device 80 according to the present embodiment is configured such that the spacer 82 is provided on the non-emitting portion 22*b* which is located at an end portion of the organic EL panel 22, and thus, does not block the light emitted from the light emitting portion 22*c*.

Figure 9:
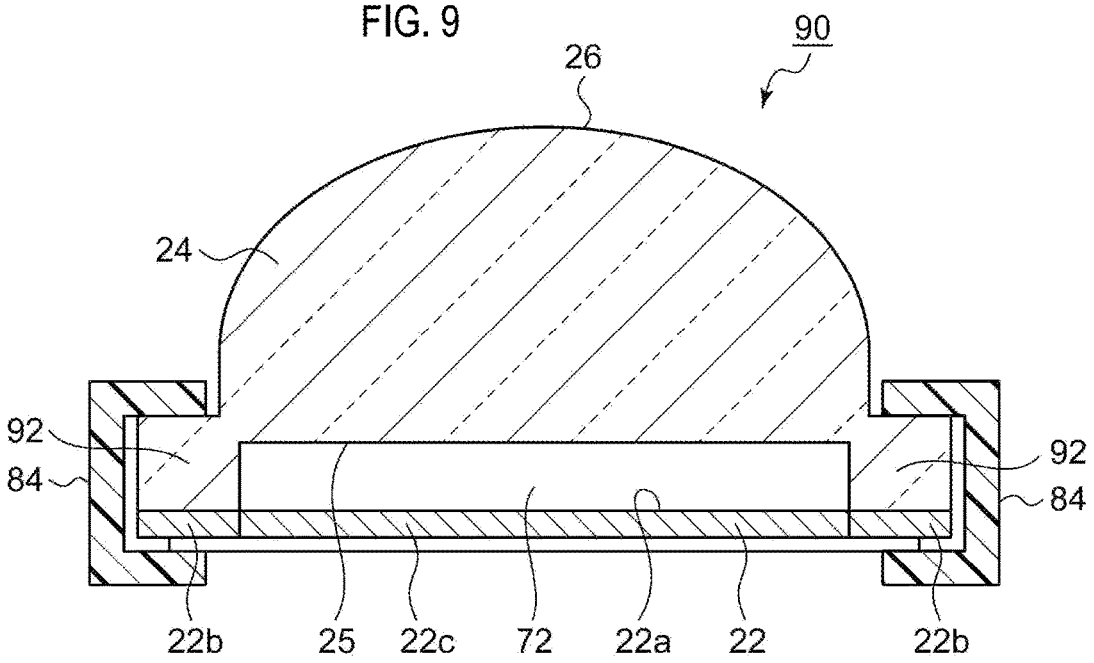
FIG. 9 is a view for explaining yet another assembly structure of the light emitting device according to the embodiment of the present invention.

FIG. 9 is a view for explaining yet another assembly structure of the light emitting device according to the embodiment of the present invention. FIG. 9 is a sectional view perpendicular to an extension direction of a light emitting device 90. As shown in FIG. 9, the light emitting device 90 is configured such that the light emitting surface 22*a* of the organic EL panel 22 and the light incidence surface 25 of the transparent member 24 are spaced apart from each other and the air layer 72 is provided therebetween.

In the light emitting device 90 shown in FIG. 9, a protruding portion 92 for defining the distance between the light emitting surface 22*a* of the organic EL panel 22 and the light incidence surface 25 of the transparent member 24 is formed at an end portion of the light incidence surface 25 of the transparent member 24. The light emitting device 90 is assembled in such a way that the transparent member 24, the protruding portion 92 of the transparent member 24 and the organic EL panel 22 are clamped by the bracket 84.

The light emitting device 90 according to the present embodiment is configured such that the protruding portion 92 is provided on the non-emitting portion 22*b* which is located at an end portion of the organic EL panel 22, and thus, does not block the light emitted from the light emitting portion 22*c*.

Figure 10B:
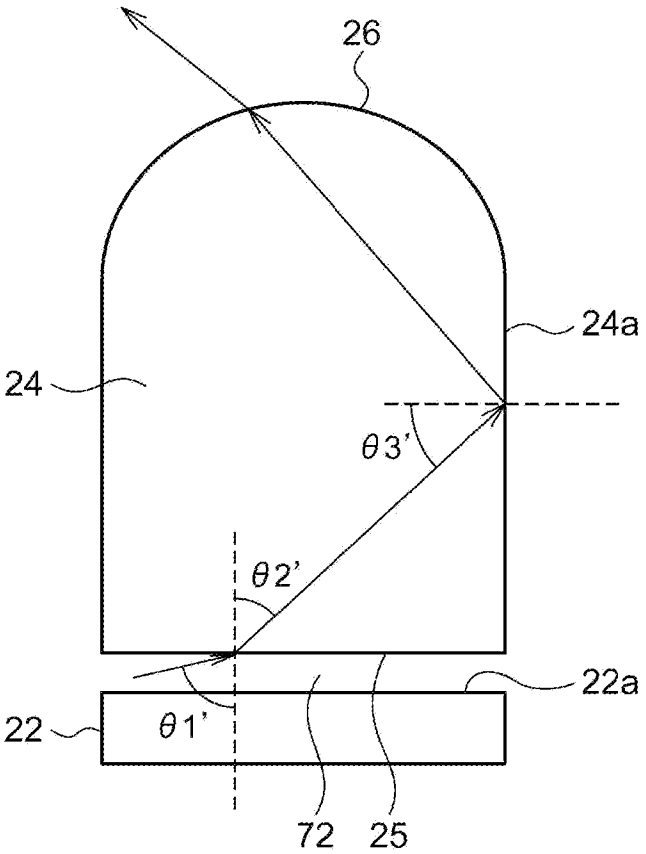
FIGS. 10A and 10B are views for explaining an advantage obtained by providing an air layer between an organic EL panel and a transparent member.
Figure 10A:
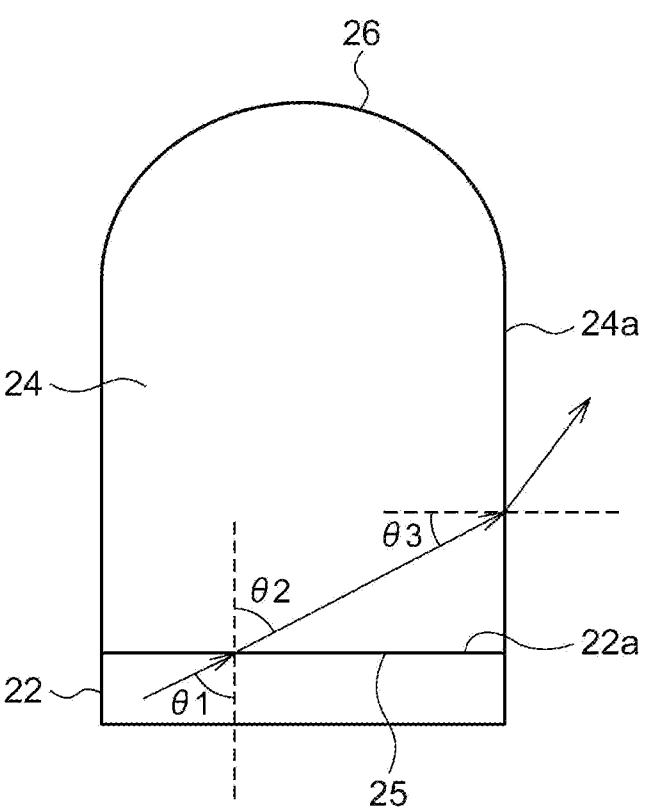

FIGS. 10A and 10B are views for explaining an advantage obtained by providing the air layer 72 between the organic EL panel 22 and the transparent member 24. Here, the refractive index of air is assumed to be 1. Further, the refractive index of both the organic EL panel 22 and the transparent member 24 is assumed to be 1.5.

FIG. 10A shows a comparative example where the light emitting surface 22*a* of the organic EL panel 22 is in close contact with the light incidence surface 25 of the transparent member 24 and an air layer is not present. At this time, it is assumed that the light emitted from the light emitting surface 22*a* at an angle θ1 is incident on the transparent member 24 at an angle θ2. Since the refractive index of the organic EL panel 22 is equal to that of the transparent member 24 and an air layer is not present, there is no refraction at the interface between the organic EL panel 22 and the transparent member 24 and θ1 is equal to θ2 (θ1=θ2). On the other hand, a critical angle θc at a side surface 24*a* of the transparent member 24 satisfies a relationship of $\theta c=\sin^{-1}(1/1.5)=41.8°$. Assuming that an incidence angle to the side surface 24*a* of the light incident on the transparent member 24 is θ3, light is emitted from the side surface 24*a* of the transparent member 24 when θ3 is less than 41.8°. Namely, since θ3 is equal to (90°−θ2), light is emitted from the side surface 24*a* of the transparent member 24 when a relationship of θ2=θ1=48.2° or more is satisfied. In the case where the amount of the light emitted from the side surface 24*a* is increased, there is a possibility that the intensity of the light emitted from the light emission surface 26 is lowered.

FIG. 10B shows an example where the air layer 72 is provided between the light emitting surface 22*a* of the organic EL panel 22 and the light incidence surface 25 of the transparent member 24. At this time, it is assumed that light is incident on the light incidence surface 25 from the air layer 72 at an angle θ1'(≈90°). The light is refracted at the interface between the air layer 72 and the light incidence surface 25 at an angle θ2'(=41.8°). The angle θ3' at which the light is incident on the side surface 24*a* of the transparent member 24 satisfies a relationship of θ3'=90°−41.8°=48.2°. Since θ3'(=48.2°) is greater than the critical angle θc) (=41.8° of the side surface 24*a*, the light is totally reflected at the side surface 24*a* and emitted from the light emission surface 26. Since the light incident on the light incidence surface 25 at an angle θ1'(≈90°) is emitted from the light emission surface 26 in this manner, theoretically, all of the light incident on the light incidence surface 25 at the angle θ1' of 90° or less is emitted from the light emission surface 26. In this way, by providing the air layer 72 between the light emitting surface 22*a* of the organic EL panel 22 and the light incidence surface 25 of the transparent member 24, it is possible to increase the intensity of the light emitted from the light emission surface 26, as compared to the above comparative example. Namely, according to the light emitting device of the present embodiment, it is possible to improve the light utilization efficiency.

Figure 11:
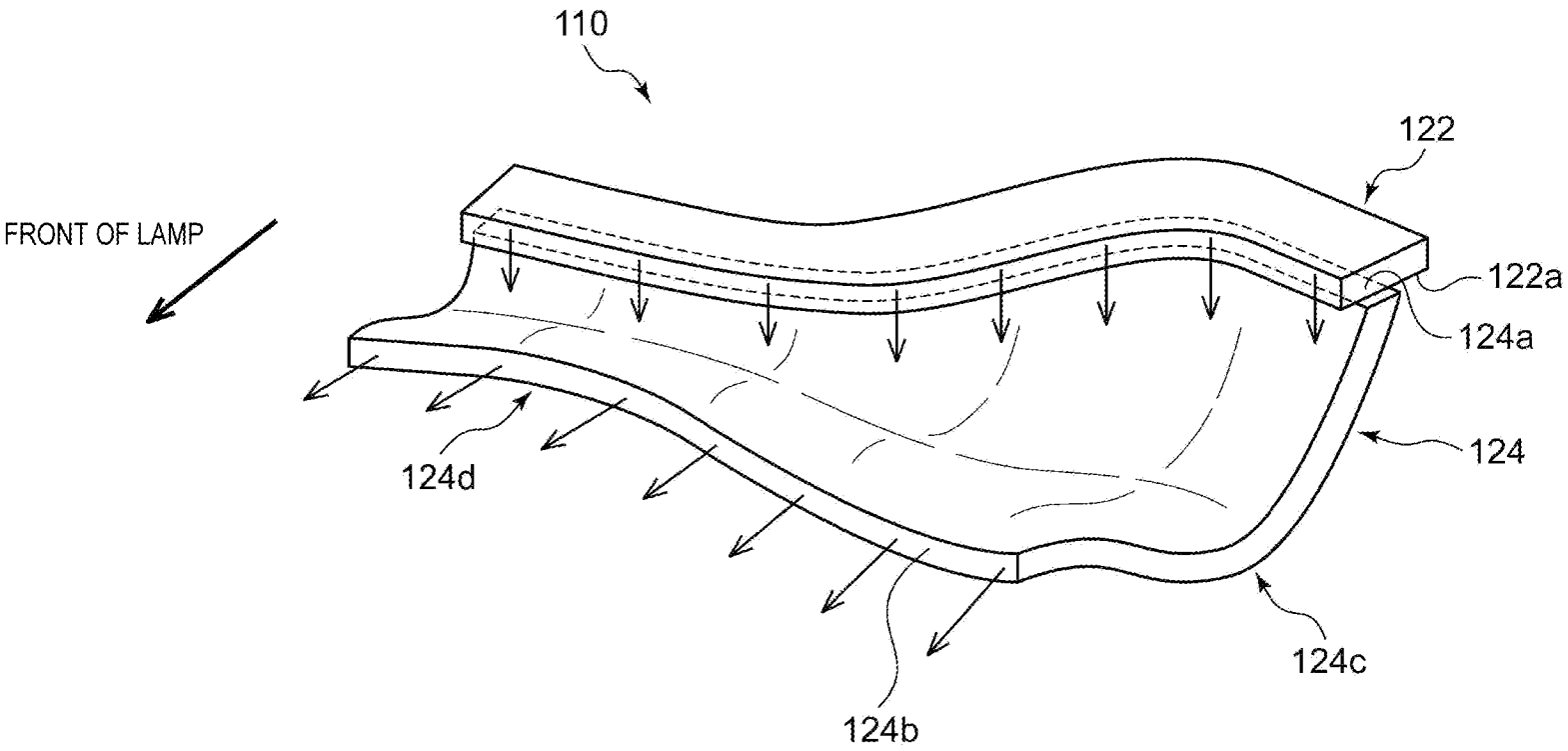
FIG. 11 is a schematic perspective view of a light emitting device according to yet another embodiment of the present invention.
Figure 12:
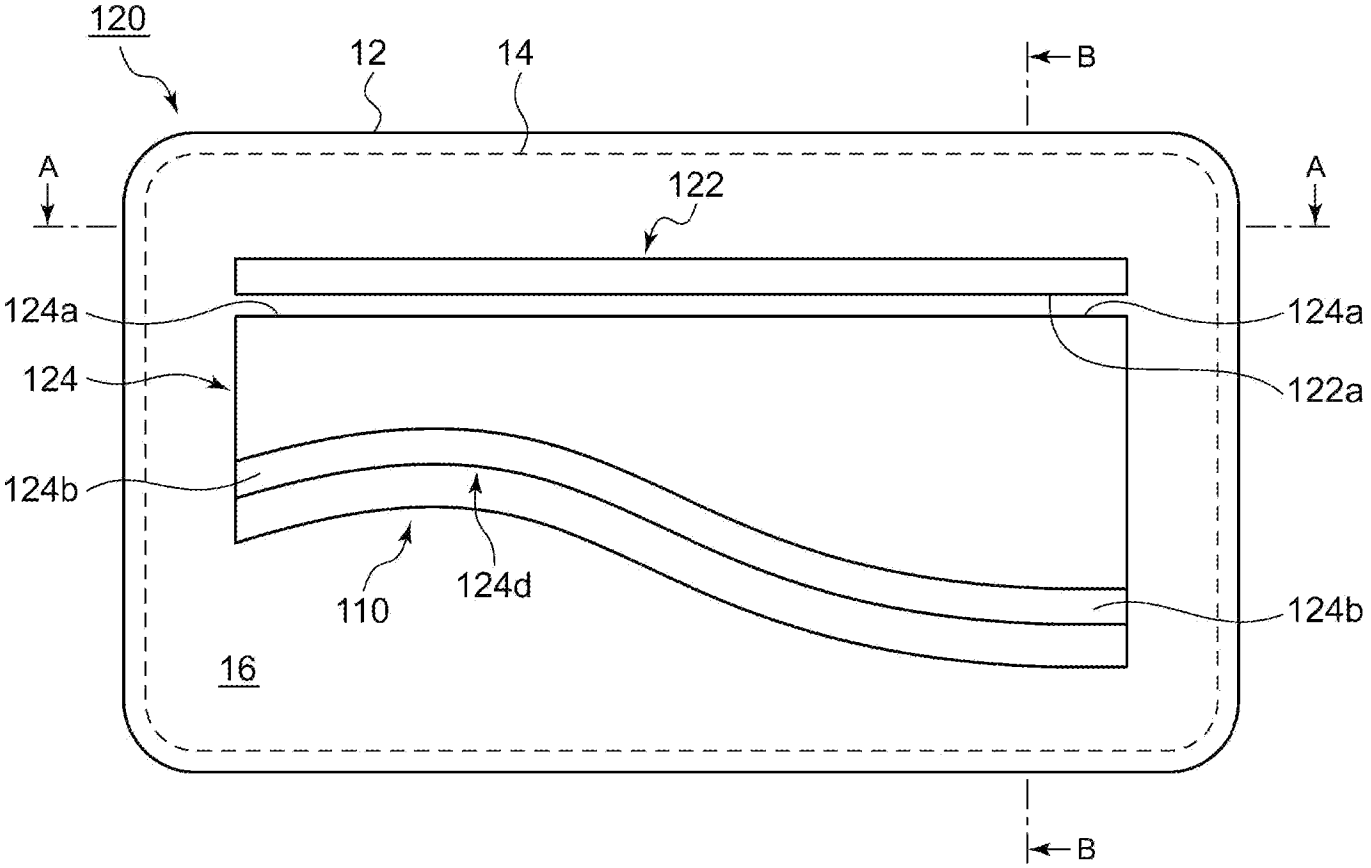
FIG. 12 is a schematic front view of a vehicle lamp using the light emitting device shown in FIG. 11.
Figure 13:
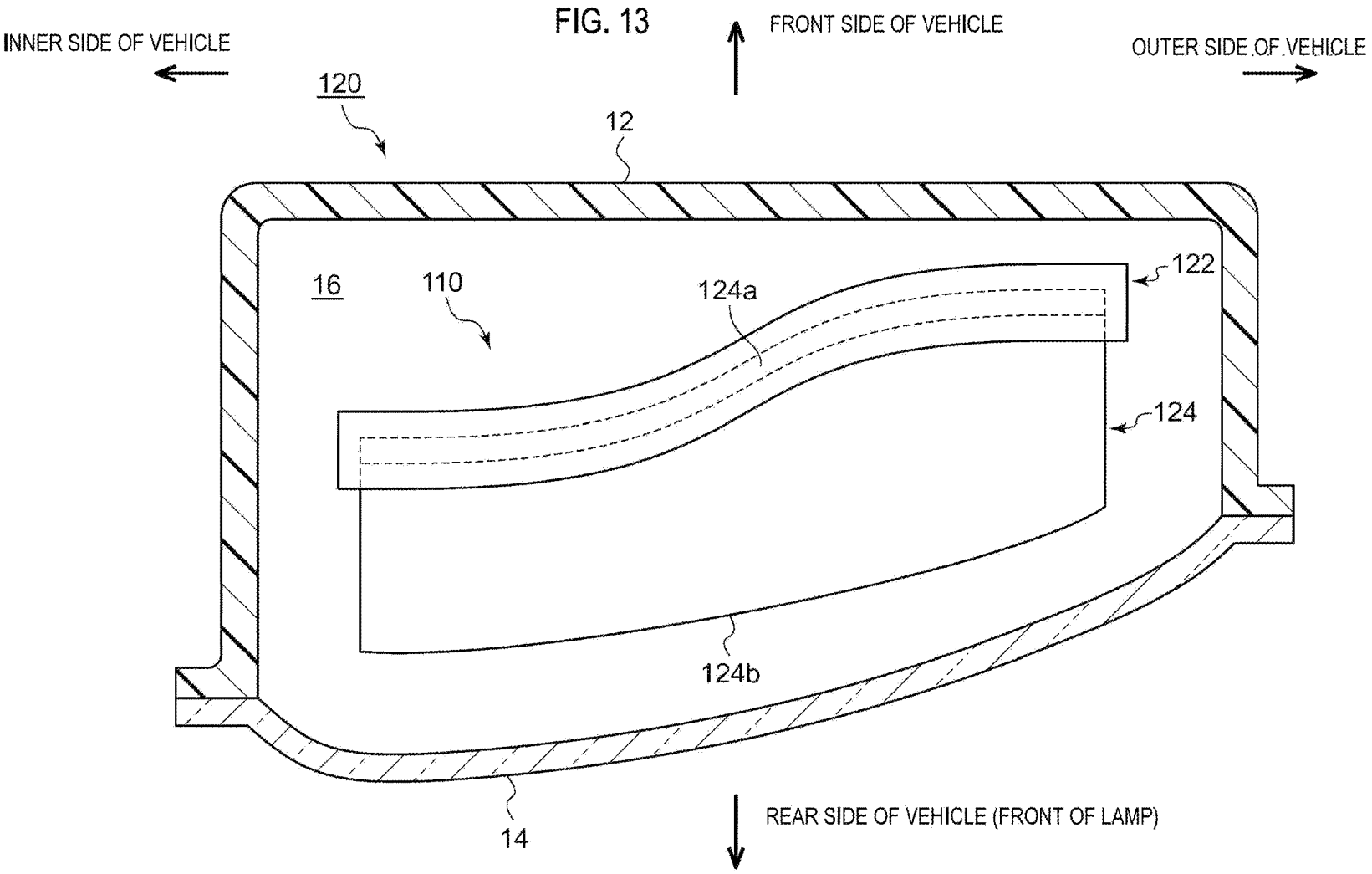
FIG. 13 is a schematic sectional view taken along a line A-A in the vehicle lamp shown in FIG. 12.
Figure 14:
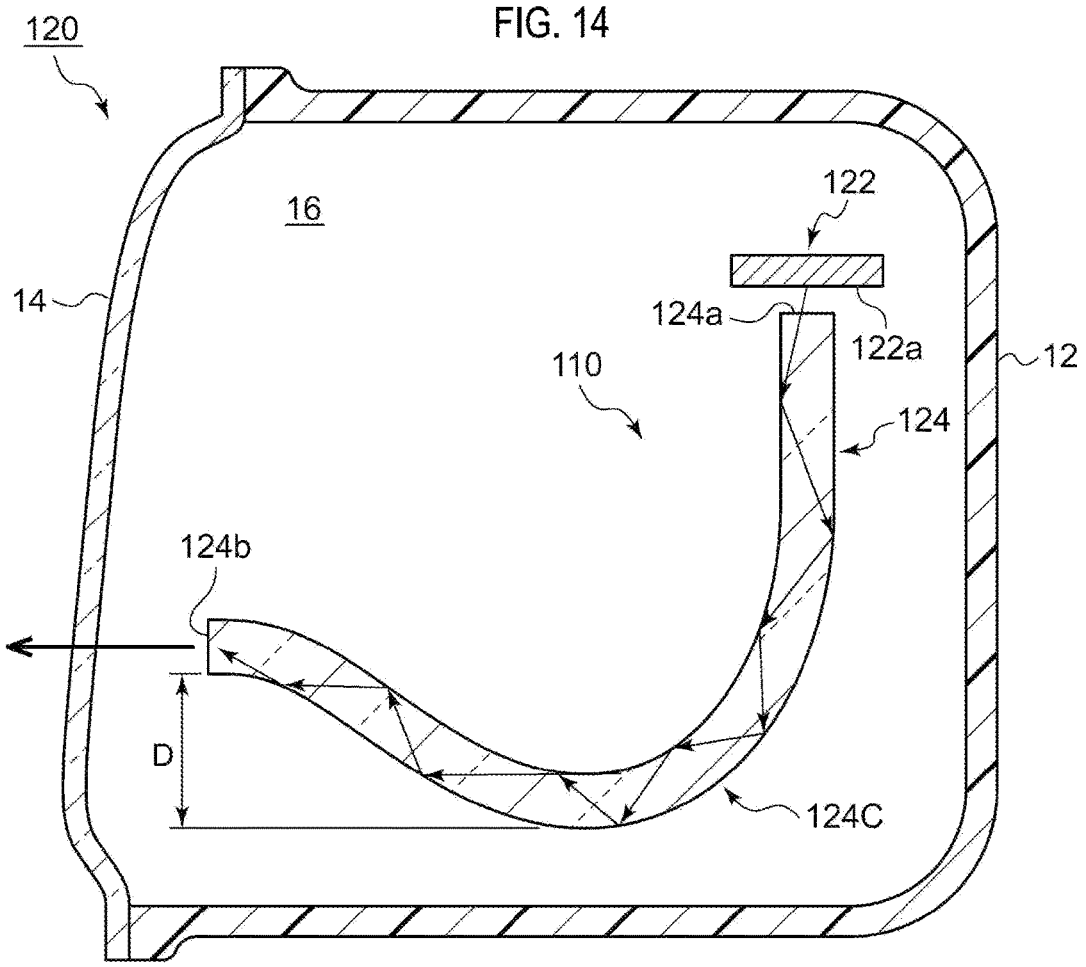
FIG. 14 is a schematic sectional view taken along a line B-B in the vehicle lamp shown in FIG. 12.

FIG. 11 is a schematic perspective view of a light emitting device 110 according to yet another embodiment of the present invention. FIG. 12 is a schematic front view of a vehicle lamp 120 using the light emitting device 110 shown in FIG. 11. FIG. 13 is a schematic sectional view taken along a line A-A in the vehicle lamp 120 shown in FIG. 12. FIG. 14 is a schematic sectional view taken along a line B-B in the vehicle lamp 120 shown in FIG. 12.

The vehicle lamp 120 of the present embodiment is a tail lamp provided in a rear right portion of a vehicle. As shown in FIG. 13, the cover 14 of the vehicle lamp 120 has a shape to follow the shape of the rear portion of the vehicle and is smoothly inclined to the front side of the vehicle toward the outer side from the inner side of the vehicle.

As shown in FIGS. 11 to 14, the light emitting device 110 includes one organic EL panel 122 having a planar shape and a transparent member 124 for controlling the light from the organic EL panel 122 to emit the light to the front of the lamp.

As shown in FIGS. 11 to 14, the organic EL panel 122 is an elongated organic EL panel which is formed so as to extend in the vehicle width direction (vehicle inside-outside direction). A central portion of the organic EL panel 122 is curved to the front side of the vehicle toward the outer side from the inner side of the vehicle. The organic EL panel 122 is arranged such that a light emission surface 122*a* thereof faces downward. In the present embodiment, the organic EL panel is illustrated as an example of the planar light emitting body. However, the planar light emitting body is not limited to the organic EL panel.

As shown in FIGS. 11 to 14, the transparent member 124 is a plate-shaped light guide which is three-dimensionally curved. The transparent member 124 extends not only in the vehicle width direction (vehicle inside-outside direction) but also in the vehicle length direction (vehicle front-rear direction). One side surface of the transparent member 124 is formed as a light incidence surface 124*a* on which the light from the organic EL panel 122 is incident. Further, another side surface of the transparent member 124 opposite to the light incidence surface 124*a* is formed as a light emission surface 124*b* for emitting the light propagated (guided) in the transparent member to the front of the lamp.

The transparent member 124 is arranged such that the light incidence surface 124*a* faces the light emission surface 122*a* of the organic EL panel 122 and the light emission surface 124*b* faces the front of the lamp. Also in the present embodiment, the light emission surface 122*a* of the organic EL panel 122 and the light incidence surface 124*a* of the transparent member 124 are spaced apart from each other and an air layer is provided therebetween.

As shown in FIG. 14, the light emitted from the light emission surface 122*a* of the organic EL panel 122 is incident on the transparent member 124 from the light incidence surface 124*a*. The light incident on the transparent member 124 travels while repeating the total reflection in the interior of the transparent member 124 and is emitted to the outside from the light emission surface 124*b*, i.e., to the front of the lamp.

Also in the transparent member 124 of the present embodiment, the distance between the light incidence surface 124*a* and the light emission surface 124*b* changes in accordance with the position in the vehicle width direction. Here, in the present embodiment, the "distance" means a distance in an extension direction from the light incidence surface 124*a* toward the light emission surface 124*b*. Since, in this way, the distance between the light incidence surface 124*a* and the light emission surface 124*b* changes in accordance with the position in the vehicle width direction, the light emitting device 110 according to the present embodiment can present a depth feeling (three-dimensional appearance) to a viewer during light emission, thereby improving the design. The light emitting device 110 according to the present embodiment can also present a depth feeling by using the planar organic EL panel 122.

Further, the transparent member 124 according to the present embodiment has a bent portion 124*c* between the light incidence surface 124*a* and the light emission surface 124*b*, as can be seen from FIGS. 11 and 14. The bent portion 124*c* is bent toward the front of the lamp from the vertical direction. The bent portion 124*c* is spaced from the light emission surface 124*b* in the normal direction of the light emitting surface of the organic EL panel 122. Namely, as shown in FIG. 14, the bent portion 124*c* of the transparent member 124 is located at a distance D below the light emission surface 124*b*. Since the transparent member 124 has such bent portion 124*c*, the light emitting device 110 according to the present embodiment can more present a depth feeling to a viewer during light emission.

Furthermore, the light emission surface 124*b* of the transparent member 124 according to the present embodiment has a bent portion 124*d* bent in the vehicle width direction, as can be seen from FIGS. 11 and 12. The bent portion 124 may be a wave shape as shown in FIGS. 11 and 12, for example. Since the light emission surface 124*b* has such bent portion 124*d*, the light emitting device 110 according to the present embodiment can even more present a depth feeling a viewer during light emission.

Figure 15:
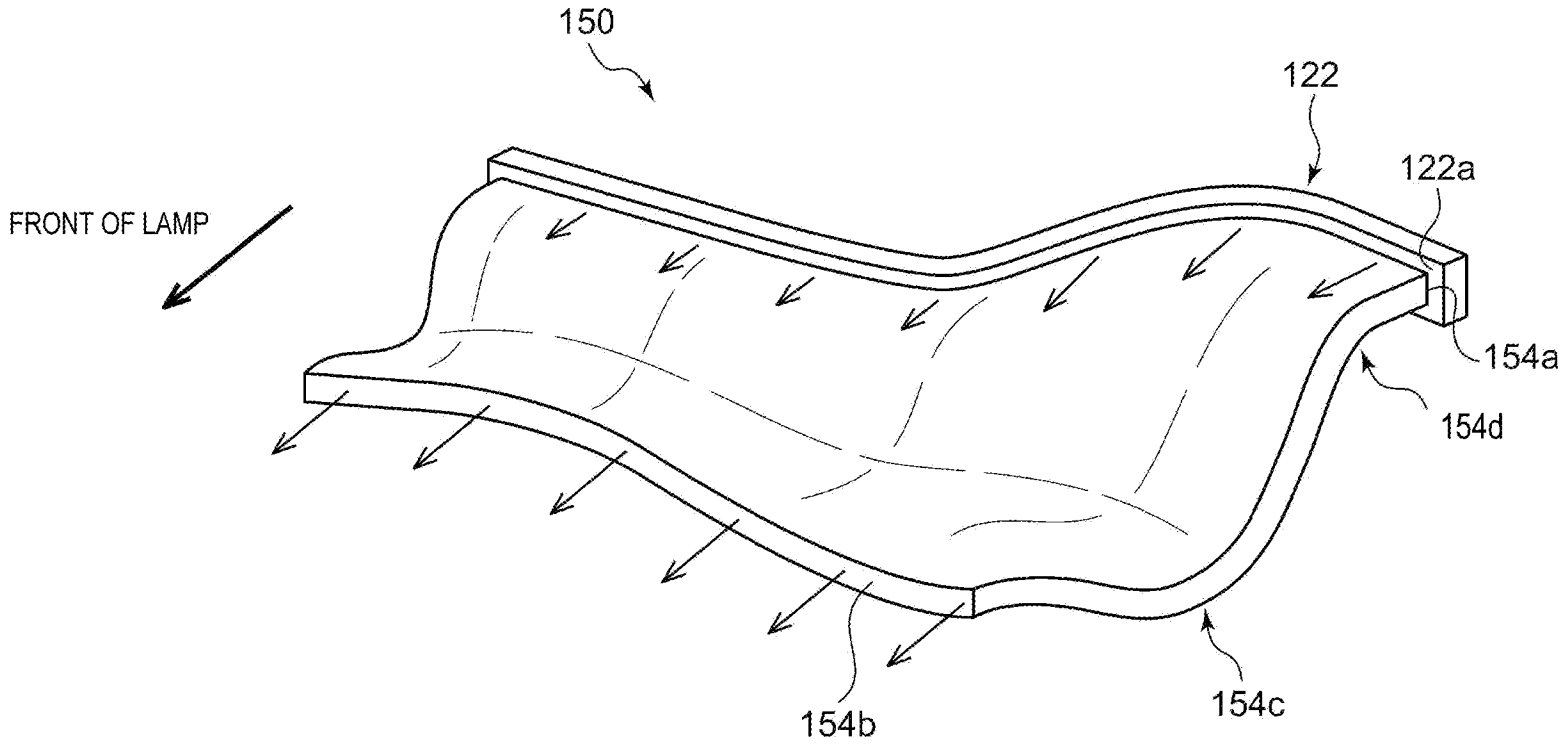
FIG. 15 is a schematic perspective view of a light emitting device according to yet another embodiment of the present invention.

FIG. 15 is a schematic perspective view of a light emitting device 150 according to yet another embodiment of the present invention. A transparent member 154 of the light emitting device 150 shown in FIG. 15 has a shape different from the transparent member 124 of the light emitting device 110 described above. Between a light incidence surface 154*a* and a light emission surface 154*b*, the transparent member 154 of the present embodiment has a second bent portion 154*d* bent toward the rear of the lamp from the vertical direction, in addition to a first bent portion 154*c* bent toward the front of the lamp from the vertical direction. Further, the organic EL panel 122 is arranged such that the light emission surface 122*a* thereof faces the front of the lamp.

The light emitting device 150 according to the present embodiment is configured such that the light emitted from the light emission surface 122*a* of the organic EL panel 122 is incident on the transparent member 154 from the light incidence surface 154*a*. The light incident on the transparent member 154 sequentially passes through the second bent portion 154*d* and the first bent portion 154*c* while repeating the total reflection in the interior of the transparent member 154, and then, is emitted to the outside from the light emission surface 154*b*, i.e., to the front of the lamp.

By having the second bent portion 154*d* in addition to the first bent portion 154*c*, the transparent member 154 of the present embodiment can more present a depth feeling to a viewer during light emission, thereby improving the design. The light emitting device 150 according to the present embodiment can also present a depth feeling by using the planar organic EL panel 122.

Figure 16:
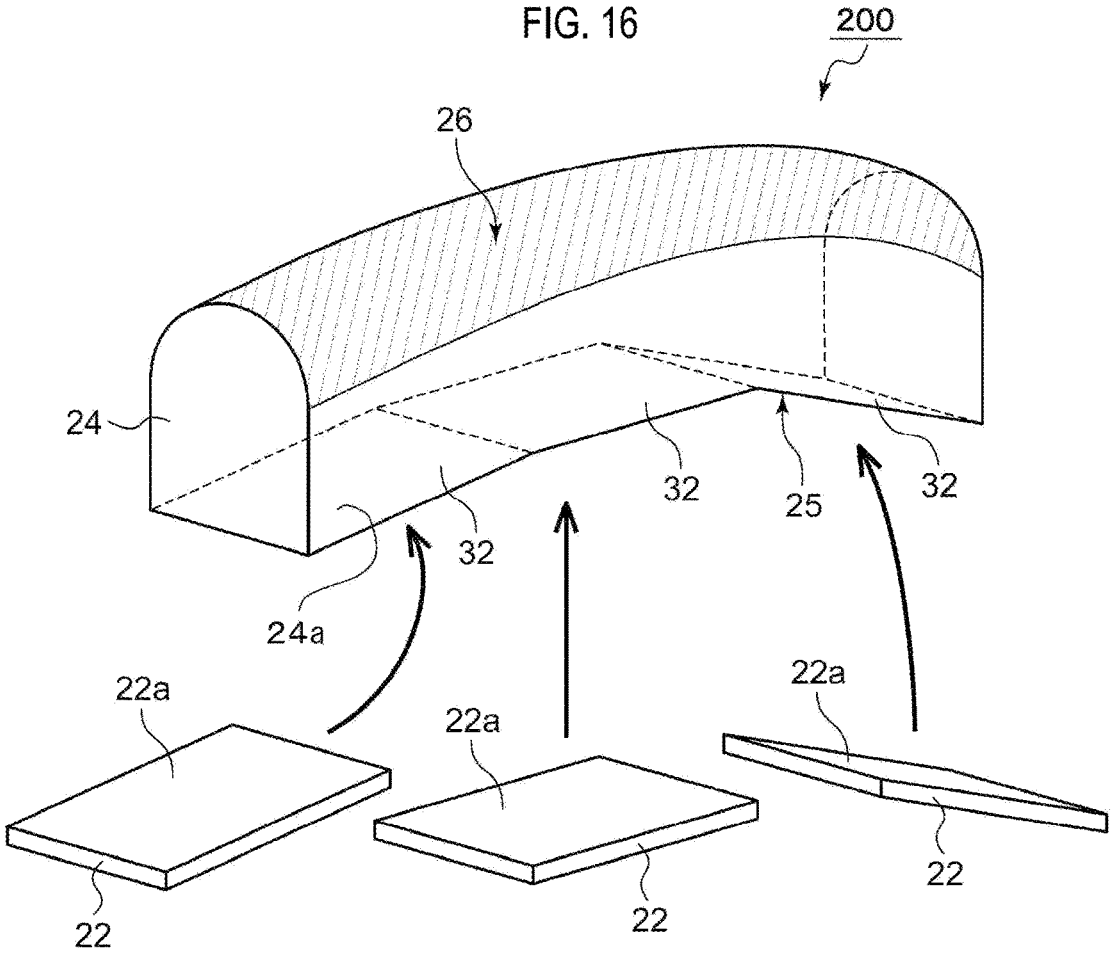
FIG. 16 is a schematic exploded perspective view of a light emitting device according to yet another embodiment of the present invention.

FIG. 16 is a schematic exploded perspective view of a light emitting device 200 according to yet another embodiment of the present invention. Similarly to the light emitting device 30 shown in FIG. 3, the light emitting device 200 according to the present embodiment includes three planar organic EL panels 22 and the transparent member 24 that is a substantially columnar body. The light emitting surface 22*a* of the organic EL panel 22 and the planar surface 32 of the light incidence surface 25 of the transparent member 24 are spaced apart from each other and an air layer is provided therebetween. Also in the light emitting device 200 according to the present embodiment, the distance between the light incidence surface 25 and the light emission surface 26 changes in accordance with the position in the vehicle width direction. The light emission surface 26 of the transparent member 24 has a semi-cylindrical section.

In the light emitting device 200 according to the present embodiment, a diffusion process (indicated by a hatching) for diffusing the light emitted to the outside from the light emission surface 26 is performed on the light emission surface 26 of the transparent member 24. The diffusion process may be a frosting process, for example. Alternatively, the diffusion process may be a process for sticking a diffusion member such as a diffusion sheet to the light emission surface. The diffusion process may be performed on the entire surface of the light emission surface 26 or may be performed on a portion of the light emission surface 26. Further, a mirror-finishing process may be performed on the side surface 24*a* of the transparent member 24.

In the light emitting device 200 according to the present embodiment, the diffusion process is performed on the light emission surface 26 of the transparent member 24. Therefore, the organic EL panel 22 is hardly visible from the outside and the shape of the light emission surface 26 is easily visible. As a result, the portion of the light emission surface 26, on which the diffusion process is performed, can give an impression as if floating in the air to a viewer, thereby improving the design. It should be noted that the light emitting device 20 according to the present embodiment can present the impression as described above by using the planar organic EL panel 22.

Figure 17C:
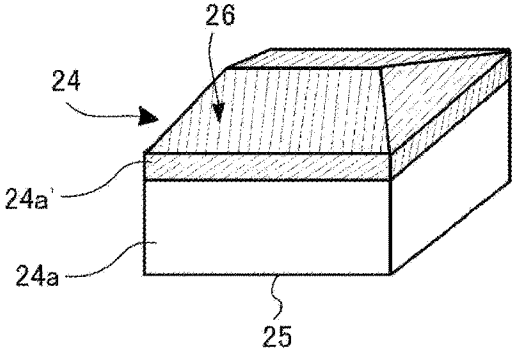
FIGS. 17A to 17C are views showing a modified example of the light emitting device shown in FIG. 16.
Figure 17B:
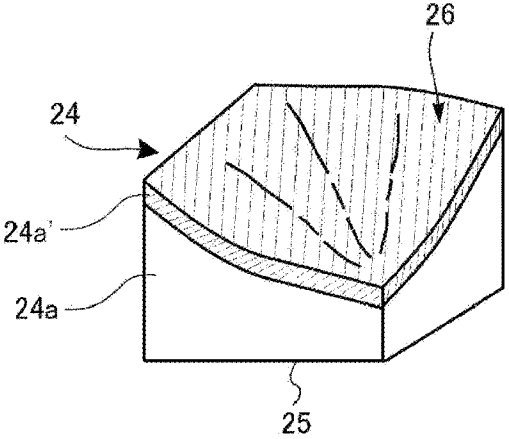
Figure 17A:
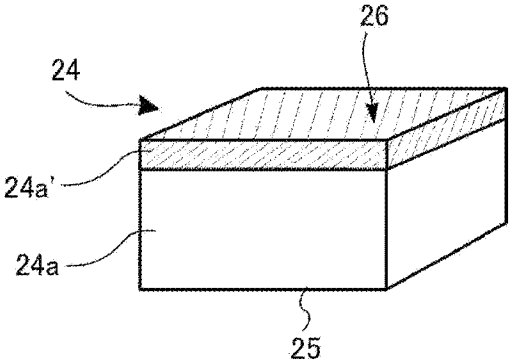

FIGS. 17A to 17C are views showing a modified example of the light emitting device 200 shown in FIG. 16. FIGS. 17A to 17C show a portion of the transparent member 24. In FIGS. 17A to 17C, only the transparent member 24 is shown, and the organic EL panel 22 is not shown.

As shown in FIGS. 17A to 17C, the light emission surface 26 is not limited to the semi-cylindrical section shape but can take various shapes. In FIG. 17A, the light emission surface 26 of the transparent member 24 has a planar shape. The diffusion process is performed on the light emission surface 26 having the planar shape. In FIG. 17B, the light emission surface 26 of the transparent member 24 has a three-dimensional curved shape. The diffusion process is performed on the light emission surface 26 having the three-dimensional curved shape. In FIG. 17C, the light emission surface 26 of the transparent member 24 has a triangular section. The diffusion process is performed on the light emission surface 26 having the triangular section. Similarly to the light emitting device 200 shown in FIG. 16, also in each example shown in FIGS. 17A to 17C, the portion of the light emission surface 26, on which the diffusion process is performed, can give an impression as if floating in the air to a viewer, thereby improving the design.

In each example shown in FIGS. 17A to 17C, the mirror-finishing process may be performed on the side surface 24*a* of the transparent member 24. Further, instead of the mirror-finishing process, the diffusion process may be performed on a portion 24*a*' of the side surface 24*a* of the transparent member 24, which is close to the light emission surface 26.

Hereinabove, the present invention has been described on the basis of the embodiments. It is understood by those skilled in the art that these embodiments are illustrative, various modified examples to the combinations of each component or each process are possible and these modified examples are within the scope of the present invention.

What is claimed is:

1. A light emitting device comprising:

a plurality of planar light emitting bodies configured to emit light in a light emitting direction; and a transparent member configured to control the light from the planar light emitting bodies, the transparent member having a light incidence surface and a light emission surface, the light incidence surface arranged so as to face light emitting surfaces of the planar light emitting bodies and configured to cause the light from the planar light emitting bodies to be incident on the transparent member, the light emission surface configured to emit, to the outside, the light which is propagated in the transparent member, wherein the planar light emitting bodies are sequentially arranged in an extending direction, wherein the transparent member is formed so as to extend in the extending direction, and formed such that a distance between the light incidence surface and the light emission surface changes in accordance with a position in the extending direction.

2. The light emitting device according to claim 1, wherein the light incidence surface is formed in a wave shape.

3. The light emitting device according to claim 1, wherein the transparent member has a bent portion between the light incidence surface and the light emission surface.

4. The light emitting device according to claim 3, wherein the bent portion is spaced from the light emission surface in the normal direction of the light emitting surfaces of the planar light emitting bodies.

5. The light emitting device according to claim 3, wherein the light emission surface is bent with respect to a predetermined direction transverse to the light emitting direction.

6. The light emitting device according to claim 1, wherein an air layer is provided between the light emitting surfaces of the planar light emitting bodies and the transparent member.

7. The light emitting device according to claim 1, further comprising a diffusion sheet for diffusing the light emitted to the outside from the light emission surface, wherein the diffusion sheet is located on at least a portion of the light emission surface.

8. The light emitting device according to claim 7, wherein the diffusion sheet is a frosting sheet.

9. A vehicle lamp comprising the light emitting device according to claim 1 as a light source.

10. The light emitting device according to claim 1, wherein the light incidence surface is formed in a staircase shape in the extending direction.

11. The light emitting device according to claim 1, wherein at least one planar light emitting body among the plurality of planar light emitting bodies is offset with respect to another planar light emitting body in the light emitting direction.

12. The light emitting device according to claim 1, wherein at least one planar light emitting body among the plurality of planar light emitting bodies is inclined with respect to another planar light emitting body, with respect to the light emitting direction.

13. A vehicle lamp comprising:

a planar light emitting body curved along a vehicle width direction; and a transparent member which propagates the light from the planar light emitting body, wherein the transparent member is disposed so as to face a light emitting surface of the planar light emitting body, and has a light incidence surface on which the light from the planar light emitting body is incident and a light emission surface for emitting the light propagated in the transparent member to the outside, wherein the transparent member is a plate-shaped light guide which is three-dimensionally curved and extends in the vehicle width direction and in a vehicle length direction, and the transparent member is formed so that a distance between the light incidence surface and the light emission surface changes in accordance with a position in the vehicle width direction.

* * * * *